US005263422A

United States Patent [19]

Barefoot

[11] Patent Number: 5,263,422

[45] Date of Patent: Nov. 23, 1993

[54] PROTECTED GATE LOCK FOR HOPPER CARS

[75] Inventor: Richard Barefoot, Marietta, S.C.

[73] Assignee: Ellcon National, Inc., Greenville, S.C.

[21] Appl. No.: 986,279

[22] Filed: Dec. 7, 1992

[51] Int. Cl.[5] ..... B61D 7/00

[52] U.S. Cl. ..... 105/308.1; 105/282.1; 105/282.3; 105/308.2; 105/305

[58] Field of Search ..... 105/280, 282.1, 282.2, 105/282.3, 296, 305, 308.1, 308.2, 250, 253; 222/559, 561, 153, 560; 298/27

[56] References Cited

U.S. PATENT DOCUMENTS

| | | | |
|---|---|---|---|
| 278,343 | 5/1883 | King | 105/308.2 |
| 1,305,351 | 6/1919 | Gandek | 105/282.1 |
| 1,692,276 | 11/1928 | Motisher | 105/305 |
| 2,668,684 | 2/1954 | Metzger | 222/560 |
| 2,738,737 | 3/1956 | Zimmer | 105/282.2 |
| 3,138,117 | 6/1964 | Dorey | 105/282.3 |
| 3,461,817 | 8/1969 | Farmer | 105/282.3 |
| 3,958,514 | 5/1976 | Akester et al. | 105/282.2 |
| 4,094,252 | 6/1978 | Koranda | 105/282.3 |
| 4,099,464 | 7/1978 | Adler | 105/282.1 |
| 4,112,852 | 9/1978 | Koranda | 105/282.2 |
| 4,224,879 | 9/1980 | Van Auken | 105/282.3 |
| 4,248,158 | 2/1981 | Chierici et al. | 105/282.3 |
| 4,360,295 | 11/1982 | Anderson | 105/282.2 |

*Primary Examiner*—Mark T. Le
*Attorney, Agent, or Firm*—Brooks Haidt Haffner & Delahunty

[57] ABSTRACT

Hopper apparatus for controlling the discharge of lading from a hopper of a railway car through an opening in which a door opens and closes the opening and is moved from the closed position to the opening position by rotatable gears and by racks attached to the door. The door is curved and rides on tracks disposed to urge the door to its closed position by gravity. The gears are rotated by a drive shaft having end portions for receiving a rotating tool,and the door is locked in its closed position by locking means including a ratchet wheel on the drive shaft and a pawl controlled by a handle assembly which, in the locked position of the door, covers the end portions of the drive shaft so that it is necessary to move the handle assembly to expose the end portions and to release the pawl from the ratchet wheel before the drive shaft can be rotated to open the door. Also, a relationship between the number of teeth on the ratchet wheel and the door drive to provide small locking increments and a spring bias on the pawl to prevent disengagement of the pawl from the ratchet wheel during car transit.

12 Claims, 5 Drawing Sheets

PROTECTED GATE LOCK FOR HOPPER CARS

BACKGROUND OF THE INVENTION

1. Field of the Invention

The invention relates to a lock for the gate which closes the discharge opening of a hopper railway car or truck, which prevents opening of the gate until the lock has been released and which holds the gate in its closed position after the gate has been closed.

2. Description of Prior Art

Gates, or sliding doors, for closing and sealing a discharge opening in a hopper car are well known in the art. See, for example, U.S. Pat. Nos. 2,926,963; 2,962,325; 3,956,996; 4,301,741; 4,360,295; 4,388,026; 4,450,773 and 4,617,868. Generally speaking, the gate closes an opening in the bottom of a car to retain the lading, which usually is particulate in the car until it is desired to discharge the lading from the car. The gate is moved from its closed position to uncover the opening and permit the discharge of the lading.

When the car is empty, the force to move the gate is small relative to the force required when the car is full and the lading contacts the gate. In some cases, the force of gravity is used to assist and maintain the closing of the gate of an empty car. However, a manually operable mechanism is used for opening and closing the gate and various devices are used for locking the mechanism when the gate is closed.

Such manually operable mechanism can, for example, be a rack or racks secured to the gate and having teeth engageable with the teeth of one or more manually rotatable pinion gears mounted on a shaft having an end, which is square in cross-section, for receiving a wrench or tool or which has through holes for receiving a rod or bar, for rotating the shaft and the pinion gear or gears in one direction or another for opening and closing the gate.

Also, it is customary to lock the gate operating mechanism in the position thereof in which the gate is closed to prevent unintentional opening of the gate during travel of the car. Also, a seal, such as a wire sealing band, may be attached to the locking device so that the latter cannot be unlocked without breaking the seal.

A problem with prior art gate operating mechanisms is that workmen often attempt to rotate the rotatable shaft carrying the pinion gear or gears without opening or releasing the lock and cause damage to the lock gate and/or drive system.

Another problem is that resilient seals for sealing the gate to the periphery of the discharge opening develop set and wear so that a lock which operates only in one position of the gate does not, after a period of use, hold the gate in a position which provide a satisfactory seal between the gate and the periphery of the discharge opening.

OBJECTS AND SUMMARY OF THE INVENTION

One object of the invention is to prevent access of a workman to the manually operable component, such as the rotatable shaft, until the lock has been opened or released.

Another object of the invention is to provide a simple device which prevents access to the manually operable component until such device is moved and movement of such device causes unlocking or release of the lock.

Another object of the invention is to provide an incremental locking method by which the gate closure plate may be lockably engaged in a number of travel positions, these positions being in close enough increments to allow for contact and compression of the resilient gasket, thereby assuring a tight seal.

Another object of the invention is to provide a positive, one-way-travel lock which will permit the closure plate, if left open at the unloading facility, to work its way closed as a result of the normal in-transit draft and buff impacts sustained by the freight car.

Another object of the invention is to provide a mechanism which is readily visible and understandable to the operating personnel. All of the functioning devices, the closure seal fastening holes, the locking mechanism and the bar/drive stud operating casting with which the operation is involved, are located within inches of each other. None is under the car or otherwise hidden from view and therefore, the operator's task is simplified.

In accordance with the preferred embodiment of the invention, a toothed rack is secured to the underside of a gate or door in the form of a slidable plate which, in its closed position, closes an opening at the bottom of the car through which lading in the car can be discharged. The slidable plate is movable from its closed position to an open position, partially open or fully open, in which the lading can pass through the opening, by pinion gears mounted on a tubular shaft rotatably mounted on the car and having teeth engaging the teeth of the rack. The shaft has ends at opposite sides of the car which are accessible when the access preventing device is suitably operated and which have at least one portion, such as a non-circular portion or a portion with through-holes, for receiving a tool for rotating the shaft.

Intermediate one of the tool receiving portions and the car there is a ratchet wheel mounted on, and secured to, the shaft for rotation therewith. A tube, pivotally mounted on the car and having U-shaped arms at opposite sides of the car which arms and a tie-down plate extending between the legs of the U-shaped arms cover the tool receiving portions of the shaft when the arms are in the locked position. The tube carries a pawl which, in the locked position of the arms, engages the ratchet wheel and prevents rotation of the shaft and hence, movement of the gate in the opening direction.

When the arms are pivoted to the unlock position, the tool receiving portions of the shaft become exposed for engagement and rotation by a tool, the pawl is disengaged from the ratchet wheel and the shaft is freely rotatable.

When a car with the invention is in transit, the ratchet wheel and pawl permit the gate to move in only the closed direction. Preferably, the slidable closure plate forming the gate is curved transversely to the direction of sliding and is carried by curved tracks which cause the gate to move upwardly with respect to the discharge opening as the gate is moved toward the open position. Thus, in the absence of constraint in the closing direction by the ratchet wheel and pawl, the closure plate is urged by gravity toward the closed position so that if the car is bumped or jostled the closure plate moves only toward its closed position. If such movement is sufficient, the ratchet wheel and pawl, which provide small locking increments, will hold the closure plate in its newly assumed position.

BRIEF DESCRIPTION OF THE DRAWINGS

Other objects and advantages of the present invention will be apparent from the following detailed description of the presently preferred embodiments thereof, which description should be considered in conjunction with the accompanying drawings in which.

Although a railway car may have more than one hopper and although the invention has application to hoppers on other vehicles and to stationary hoppers, the invention will be described in connection with one conventional railway car hopper, the application of the invention to other hoppers being apparent to those skilled in the art.

Figure 1:
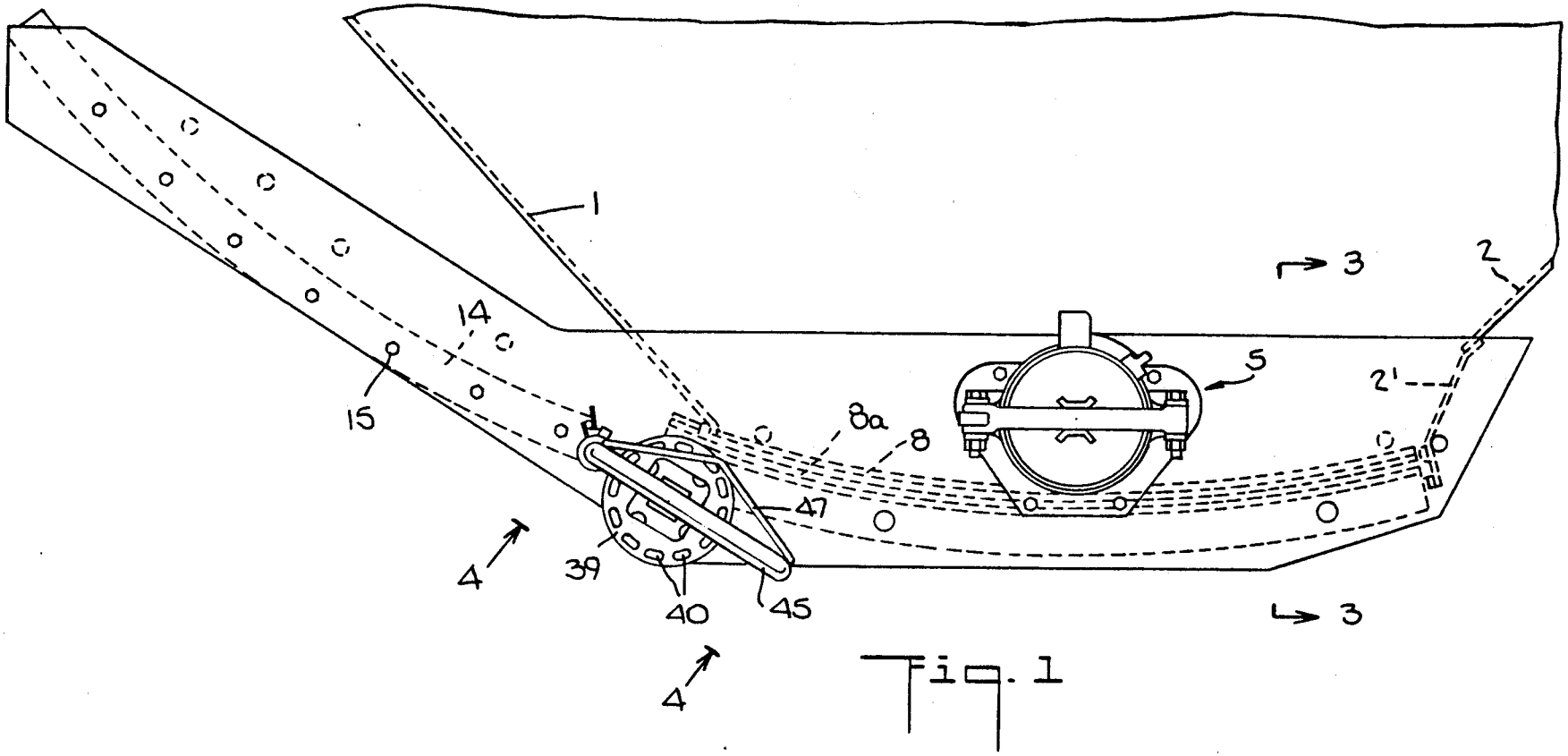
FIGS. 1 and 2 are, respectively, side and top, fragmentary and schematic views of a hopper car including the invention.
Figure 2:
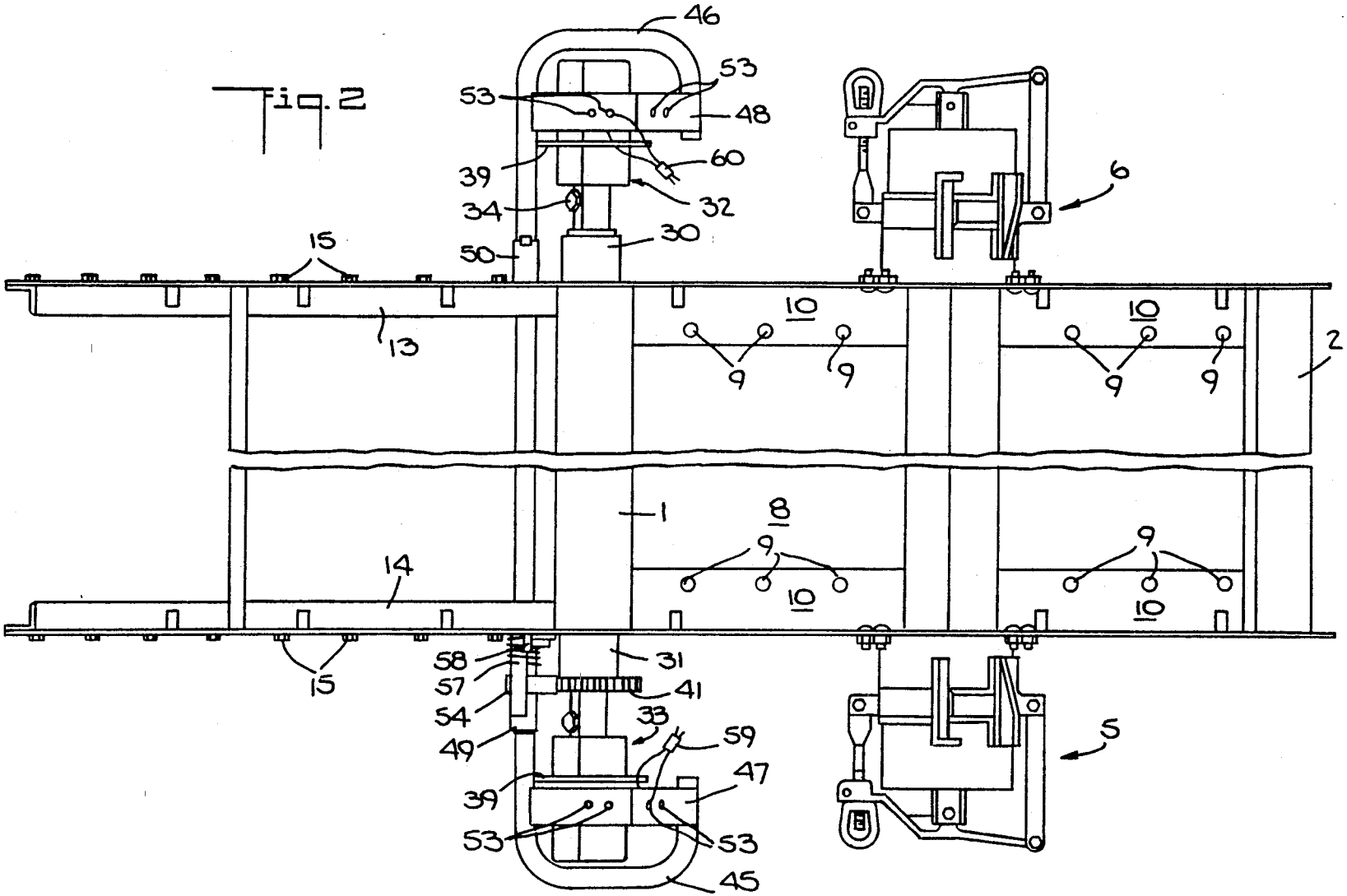
Figure 3:
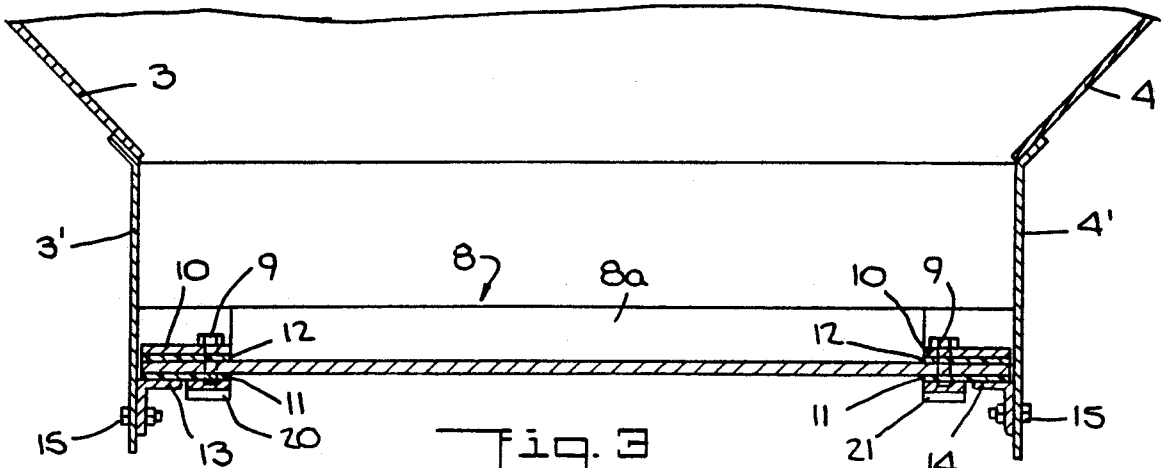
FIG. 3 is an end elevation cross-sectional view, taken along the line 3—3 indicated in FIG. 1, of the embodiment shown in FIGS. 1 and 2.

As shown in FIGS. 1, 2 and 3, the hopper has sloping side walls, or slope sheets, 1 and 2, and sloping end walls 3 and 4. The sidewall 2 has an extension 2' secured to the sidewall 2, such as by welding. The end walls 3 and 4 have vertical extensions 3' and 4' secured thereto, such as by welding.

In the preferred embodiment, the hopper has a trough with cap structures 5 and 6 of the type described in U.S. Pat. No. 4,934,877 for pneumatic removal of the particulate material, but since such trough and cap structures 5 and 6 do not form part of the present invention, a detailed description thereof is not necessary herein.

Figure 5:
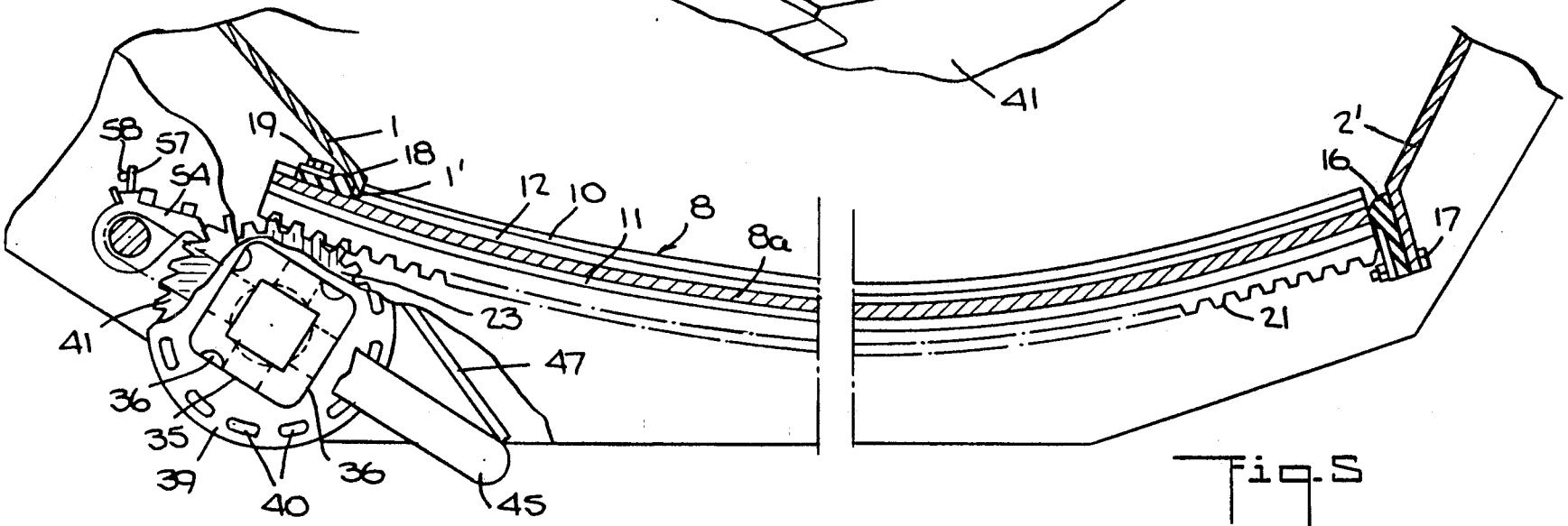
FIG. 5 is an enlarged, fragmentary side elevation view, partly in cross-section of the embodiment shown in FIGS. 1 and 2.
Figures 7, 8:
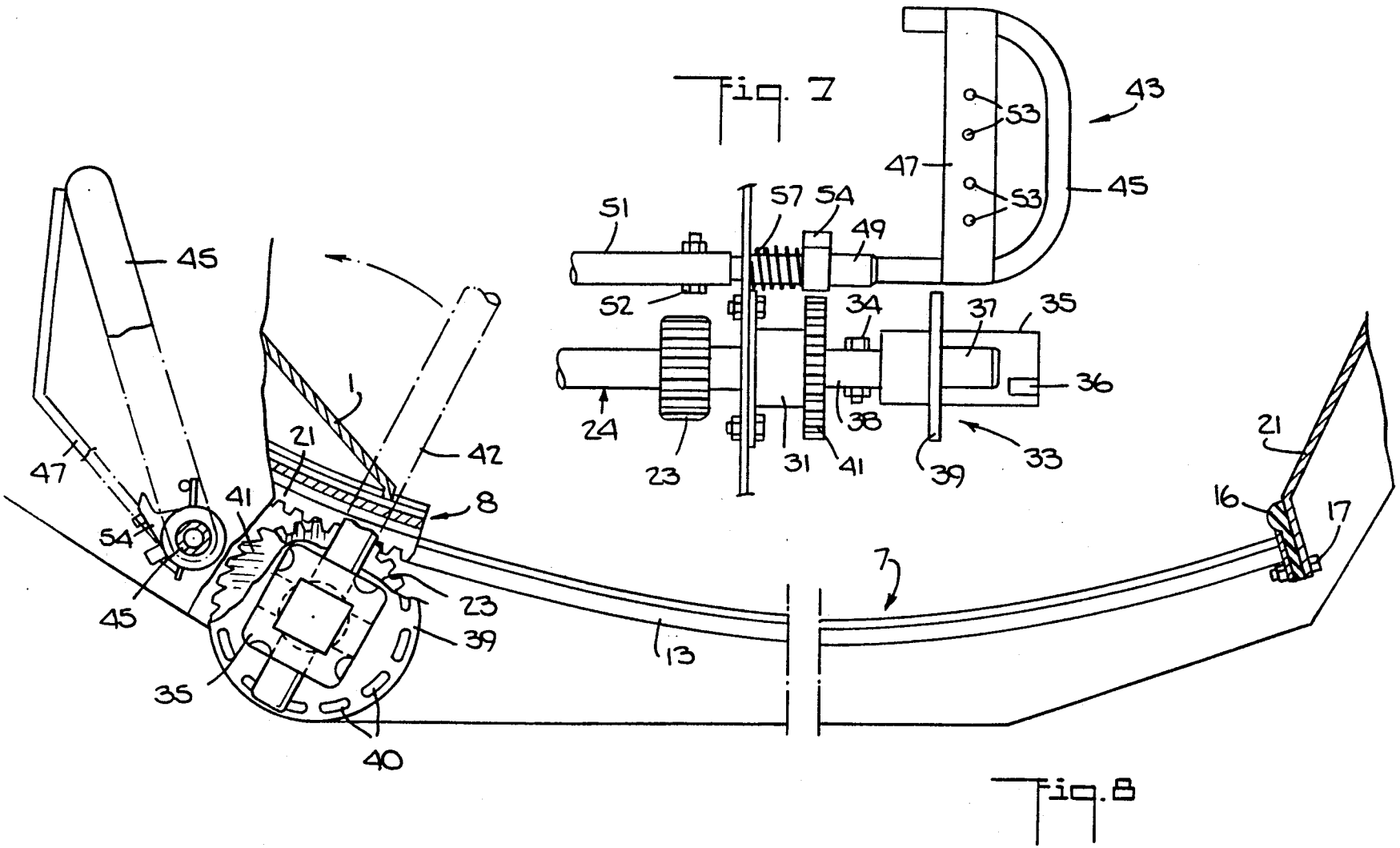
FIG. 7 is an enlarged, fragmentary, top view of the apparatus shown in FIGS. 1 and 2 with the parts in their unlocked positions.
FIG. 8 is similar to FIG. 5 but shows the parts in their unlocked positions and illustrates the engagement of a tool with the rotatable shaft which carries the pinion gears which move the gate.

As shown in FIG. 8, the hopper has an opening 7 which is openable or closable by a door or gate 8, the door 8 being in an open position in FIG. 8 and in a closed position in FIGS. 1, 2 and 5.

Preferably, the door or gate 8 comprises a curved plate 8*a* of aluminum (see FIGS. 1, 3 and 5) which, at its ends adjacent the extensions 3' and 4', has secured thereto, by bolts 9, strips of hard plastic 10 and 11 and a sealing strip 12 of rubber, such as neoprene rubber (see FIG. 3). The door 8 is concave, or curved downwardly, with respect to the direction of its movement from its closed position to its open position for reasons set forth hereinafter.

The door or gate 8 rides on a pair of supports or rails 13 and 14 (see FIGS. 1, 2, 3 and 8) which have a curvature corresponding to the curvature of the door 8 and which are secured to the extensions 3' and 4', such as by bolts 15. The supports 13 and 14 curve upwardly from the edge of the opening 7. Thus, if the door 8 is unrestrained, it is urged by gravity from the open position shown in FIG. 8 to the closed position shown in FIGS. 1, 2 and 5. Without particulate material in the hopper, the door 8 is unrestrained with respect to movement to the closed position, except by friction which is reduced by the plastic strips 11 and by particulate material passing through the opening 7, and it will normally tend to assume its closed position when the particulate material has been discharged, particularly if the vehicle carrying the hopper is jostled or bumped.

As shown in FIG. 5, extension 2' has a sealing strip 16, such as a seal of neoprene rubber, which extends from one extension 3' to the opposite extension 4' and which is secured to the extension 2', such as by bolts 17. When the door 8 is closed, the forward end thereof engages the sealing strip 16. The rear end of the door 8 carries a similar sealing strip 18 secured to the door 8, such as by bolts 19, which engages a lip 1' on the sidewall 1 when the door 8 is closed. Thus, when the door 8 is closed, the opening 7 is closed and is sealed by the sealing strips 16, 18 and 12.

Figure 4:
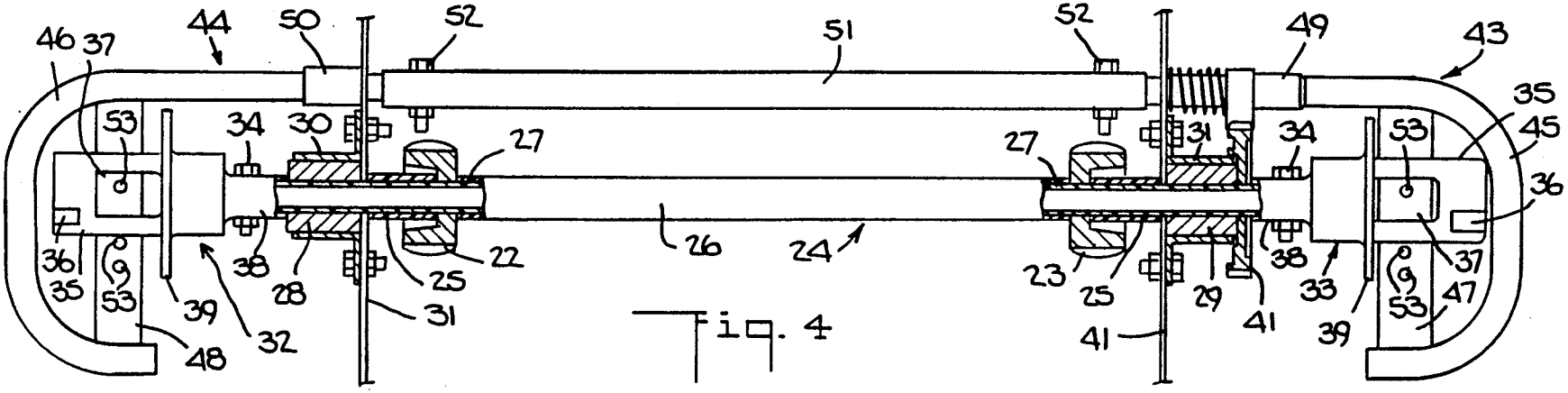
FIG. 4 is an enlarged, fragmentary end elevation view of the embodiment shown in FIGS. 1 and 2 and is taken along the line 4—4 indicated in FIG. 1.

Secured to the bottom side of the curved plate 8*a* are a pair of curved, toothed racks 20 and 21 (see FIGS. 3 and 5), the teeth of which engage with the teeth on a pair of gears 22 and 23 (see FIGS. 4, 5 and 8). Thus, as the gears 22 and 23 are rotated clockwise, as viewed in FIGS. 5 and 8, the door 8 is moved toward its closed position, and when the gears 22 and 23 are rotated counterclockwise, as viewed in FIG. 5, the door 8 is moved toward its open position.

The gears 22 and 23 are secured to a drive shaft 24 for rotation therewith (see FIGS. 4 and 7). Preferably, the drive shaft 24 is tubular and comprises three parts, an end part 25, a middle part 26 and a center part 27. The center part 27 is rotatable in bearings 28 and 29 held by supports 30 and 31 secured to the extensions 3' and 4' of the hopper end walls in any conventional manner.

Preferably, the drive shaft 24 has a pair of capstan assemblies 32 and 33 which are secured to opposite ends of the center shaft part 27 by bolts 34 so that when an assembly 32 or 33 is rotated, the shaft 24 and hence, the gears 22 and 23 are rotated to open or close the door 8.

Each assembly 32 and 33 comprises an end portion 35 (see FIGS. 4, 5 and 7) with a square cross-section and grooves 36 for receiving a power driven, axially applied, rotating tool of a known type and a through-opening 37 for receiving a long bar 42 (see FIG. 8) for manually rotating the drive shaft 24 in the event that the power driven rotating tool is not available or used. Each assembly comprises a tube 38 which fits over the center shaft section 27 and is secured to the latter by the bolt 34. The tube 38 is rotatable with the assembly.

Each assembly 32 and 33 includes a seal wheel 39 which has a plurality of openings 40 (see FIGS. 1, 5 and 8) for receiving a seal as hereinafter described. The wheel 39 is secured to the assembly so as to be rotatable with the assembly.

A toothed ratchet wheel 41 is also secured to the center shaft section 27 so as to be rotatable thereby and so that if the ratchet wheel 41 is prevented from rotating the drive shaft 24 is prevented from rotating.

Preferably, as shown in FIGS. 2 and 4, the apparatus of the invention has two locking means comprising pivotally mounted handle assemblies 43 and 44, the assembly 43 being shown in enlarged detail in FIG. 7. Each assembly has a U-shaped arm 45 and 46 which is spaced from the ends of the capstan assemblies 33 and 32, respectively, but which intersects the axis of the capstan assemblies when the handles are in a first, locking position so that a rotating tool cannot be applied axially of the assemblies 32 and 33. On the upper sides of the handles 45 and 46, bridging plates 47 and 48 are secured to the handles 45 and 46, such as by welding, and are positioned so as to prevent access to the openings 37 in the assemblies 32 and 33 from the top side of the assemblies 32 and 33 by a tool, such as the bar (FIG. 8) for rotating the assemblies 32 and 33 and hence, the drive shaft 24. Generally speaking, access to the openings 37 from below the handles 45 and 46 need not be prevented because the distance below the assemblies 32 and 33 from the latter assemblies to the car supporting rails or the ground or rail ties is too short to permit the insertion of a bar 42 into the openings 37, or to apply a wrench to the shaft end portion 35, which would have a length sufficient to provide the leverage necessary to rotate the assemblies 32 and 33, particularly when the ratchet wheel 41 is prevented from rotating by the locking means. Furthermore, it is inconvenient to insert a rotating bar or wrench from below the handles 45 and 46.

Preferably, the handles 45 and 46 are tubular, carry spacing collars 49 and 50 secured thereto and are interconnected by a tube 51 secured to the handles 45 and 46, such as by bolts 52. Thus, when either handle 45 or 46 is pivoted from its locking position as shown in FIGS. 1, 2, 4 and 5 to its unlocked position as shown in FIGS. 7 and 8, the other handle is similarly pivoted.

Although, in the preferred embodiment, there are two handle assemblies 43 and 44 and two capstan assemblies 32 and 33 to permit actuation of the locking means and rotation of the drive shaft 24 from either side of the car, the handle assembly 44 and the capstan 32 can be omitted if desired.

Preferably, the bridging plates 47 and 48 have openings 53 (FIGS. 2, 4 and 7) for receiving a seal as hereinafter described.

Figure 6:
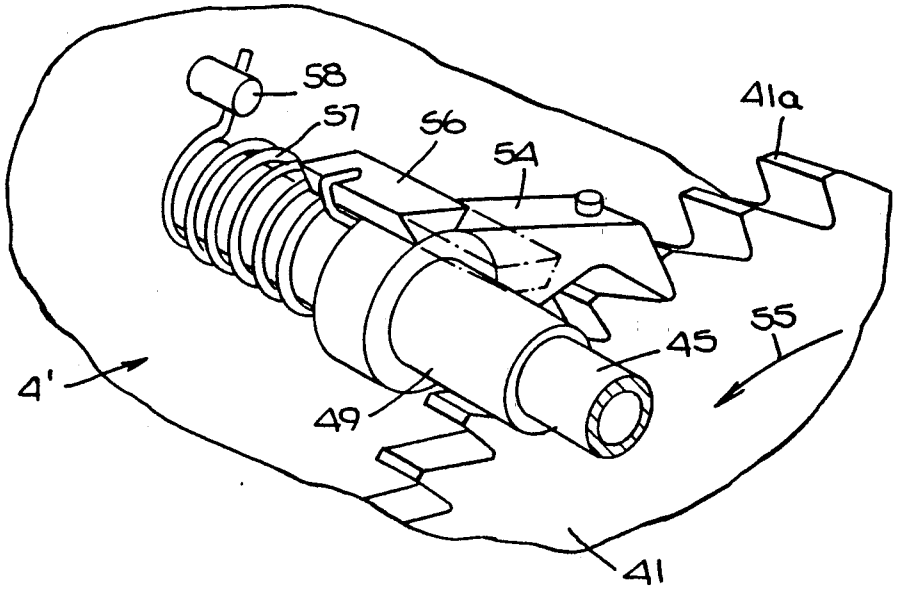
FIG. 6 is an enlarged fragmentary view of the ratchet wheel and pawl assembly used in the embodiments shown in FIGS. 1 and 2.

With particular reference to FIGS. 6 and 7, the collar 49 has a pawl 54 mounted thereon and secured thereto with its free end engageable with the teeth 41*a* of the ratchet wheel 41. In FIG. 6, the pawl 54 is in the locking position and in FIG. 7, the pawl 54 is in the unlocked position. The pawl 54, when it is in the locking position, prevents rotation of the ratchet wheel 41 in the direction of the arrow 55 (FIG. 6) but permits the ratchet wheel 41 to rotate in the opposite direction. When the pawl 54 is in the unlocked position (FIG. 7), the ratchet wheel 41 is free to rotate in either direction. The pawl 54 is pivotable into the locked and unlocked positions by the handles 45 and 46.

The pawl 54 has a projection 56 which is engaged by one end of a torsion spring 57, and the opposite end of the spring 57 engages a pin 58 fixedly mounted on the end wall extension 4'. The spring 57 is selected and mounted so that it continuously urges the free end of the pawl 54 toward the teeth 41*a* even when the pawl 54 is in the locked position shown in FIG. 6 so that when the railway car is in transmit, the pawl 54 will not become disengaged from the ratchet wheel 41 due to bouncing or bumping of the car.

Conventionally, after a car is filled with the lading, the mechanism for opening the hopper door is sealed so that the receiver of the lading can ascertian that there has been no removal of lading. As shown in FIG. 8, the locking means of the invention can be sealed by conventional wire seals 59 and 60 which extend through an opening 53 in the bridging plates 47 and 48 and an opening 40 in the sealing wheel 39. The seals 59 and 60 must be broken by movement of the handles 45 or 46 or be cut before the locking means can be moved from the locking position to the unlocking position.

It will be apparent from the foregoing that when the locking means of the invention is in the locking position, ready access to the capstan assemblies 32 and 33 is prevented by the handles 45 and 46 and the bridging plates 47 and 48. Therefore, prior to rotation of the drive shaft 24 for opening the door 8, the handles 45 and 46 must be pivoted to the door opening position, the seals 59 and 60 being broken during such pivoting or being previously cut. In the locking position of the handles 45 and 46, the pawl 54 engages a tooth 41*a* of the ratchet wheel 44 preventing rotation of such wheel and the drive shaft 24 in the direction of opening of the door 8. When the handles 45 and 46 are moved to the open position, there is ready access to the end portions 35 and the openings 37 permitting ready access to the end portions 35 and the openings 37 for rotation of the capstan assemblies 32 and 33 and hence, the drive shaft 24. When the handles 45 and 46 are in the locking position, the door 8 cannot move toward the open position but can move toward the closed position.

Since the resilient sealing strips 16 and 18 can develop "set" over a period of time or the workman may not completely close the door 8 after the lading is unloaded, the locking means will permit the door 8 to be moved to a fully closed position manually or because of the action of gravity on the door 8 even if the fully closed position is not the same as when the sealing strips 16 and 18 were new. In this connection, the spacing between the teeth 41*a* on the ratchet wheel 41 and the movement of the door 8 by the drive shaft 24, the gears 22 and 23 and the racks 20 and 21 is selected so that when the door 8 moves no more than one-quarter inch, the pawl 54 moves from one tooth 41*a* to the next adjacent tooth 41*a* on the ratchet wheel 41. In this way, the pawl 54 can lock the ratchet wheel 41 when the door 8 is at least within one-quarter inch of the fully closed position of the door 8. In other words, the locking mechanism is effective to lock the door 8 in positions which are one-quarter inch apart or less, thereby providing a good seal between the door 8 and the hopper side walls regardless of the condition of the sealing strips 16 and 18 or the failure of workman to fully close the door 8. Furthermore, the locking mechanism permits the workman closer increments of closing of the door 8 so that the workman does not have to select a position of the door 8 in which there is a substantial gap between the door 8 and the sealing strips 16 and/or 18.

In addition, because of the spring 57, the free end of the pawl 54 cannot "bounce" or otherwise come out of between a pair of teeth 41*a* so that in the transit of the car, the door 8 remains in the fully closed position.

Although preferred embodiments of the present invention have been described and illustrated, it will be apparent to those skilled in the art that various modifications may be made without departing from the principles of the invention.

I claim:

1. In hopper apparatus comprising a hopper for containing particulate material and having an opening at the lower part thereof for permitting the discharge of the particulate material and, a door for covering and closing said opening in a first position on said door, said door being movable to a second position in which said opening is at least partly uncovered to permit discharge of said particulate material, and drive means for moving said door from said first position to said second position and vice versa, wherein the improvement comprises:

a rotatable drive shaft forming part of said drive means, said drive shaft having an end portion engageable by a tool for rotating said shaft and thereby moving said door from said first position to said second position and vice versa;

a ratchet wheel having teeth, said ratchet wheel being connected to said rotatable drive shaft, such that said ratchet wheel is rotatable by said rotatable drive shaft and said ratchet wheel prevents rotation of said drive shaft when rotation of said ratchet wheel is prevented;

a pawl with a tooth engageable with said teeth on said ratchet wheel, means for biasing said pawl toward said ratchet wheel and said tooth into engagement with said teeth of said ratchet wheel, such that when said tooth of said pawl is forced into engagement with the teeth of said ratchet wheel by said biasing means, said ratchet wheel is permitted to be rotated in one direction so as to move said door into said first position and said ratchet wheel is prevented from rotation in the opposite direction; and locking means comprising a handle assembly connected to said pawl, said handle assembly having a first position in which it causes said pawl tooth to engage said teeth and a second position in which it causes said pawl tooth to be out of engagement with said teeth, said handle assembly in said first position thereof, covering at least part of said end portion of said drive shaft and thereby preventing ready access to said end portion by said tool and in said second position thereof, exposing said end portion of said drive shaft and thereby permitting ready access to said end portion by said tool whereby when said pawl tooth is in engagement with said teeth, said drive shaft cannot be rotated to move said door toward said second position of said door until said handle assembly is moved to said second position of said handle assembly to expose said end portion of said drive shaft and to move said pawl tooth out of engagement with said teeth.

2. Hopper apparatus as set forth in claim 1 wherein said end portion of said drive shaft has a periphery extending around the axis of said drive shaft and has an end face extending transversely to said axis of said drive shaft and said handle assembly is in spaced relation to said periphery of said end portion and extends around at least one-half of the periphery of said end portion, said handle assembly also having a portion adjacent to said end face of said drive shaft to prevent axial access to said end portion.

3. Hopper apparatus as set forth in claim 2 wherein said handle assembly and said end portion have openings for receiving a shipping seal which will inhibit movement of said handle from said first position of said handle until said seal is released.

4. Hopper apparatus as set forth in claim 1 wherein said drive means comprises an elongate, toothed rack secured to said door with its length extending in the direction of movement of said door, and a gear with teeth secured to said drive shaft and rotatable by said shaft, the teeth of said gear being in engagement with the teeth of said rack.

5. Hopper apparatus as set forth in claim 4 wherein the spacing between the teeth of said ratchet wheel and the amount of movement of said door caused by said drive means is selected so that said door moves not more than about one-quarter inch when said ratchet wheel rotates from a position in which one tooth of said ratchet wheel is engaged by said tooth of said pawl to a position in which the next adjacent tooth of said ratchet wheel is engaged by said tooth of said pawl.

6. Hopper apparatus as set forth in claim 5 wherein said hopper has a first side wall and a second side wall spaced from said first side wall and defining opposite sides of said opening and said door has a rearward end adjacent said first side wall and a forward end adjacent said second side wall when said door is in said first position of said door and further comprising a first resilient sealing strip intermediate said rearward end of said door and said first side wall for sealing said rearward end of said door with respect to said first side wall and a second resilient sealing strip intermediate said forward end of said door and said second side wall for sealing said forward end of said door with respect to said second side wall.

7. Hopper apparatus as set forth in claim 6 wherein said first sealing strip is mounted on said rearward end of said door and said second sealing strip is mounted on said second side wall.

8. Hopper apparatus as set forth in claim 1 wherein said means for biasing said pawl comprises spring means acting between said pawl and said hopper and urging said pawl tooth into engagement with said teeth of said ratchet wheel when said handle assembly is in said first position in which said pawl tooth engages said teeth of said ratchet wheel.

9. Hopper apparatus as set forth in claim 5 wherein said door is curved downwardly with respect to the direction of movement of said door from said first position thereof to said second position thereof and is supported by correspondingly curved supports mounted on said hopper, said supports extending upwardly from said opening whereby when said door is in said second position thereof, it is urged by gravity toward said first position.

10. Hopper apparatus as set forth in claim 1 wherein said door is curved downwardly with respect to the direction of movement of said door from said first position thereof to said second position thereof and is supported by correspondingly curved supports mounted on said hopper, said supports extending upwardly from said opening whereby when said door is in said second position thereof, it is urged by gravity toward said first position.

11. Hopper apparatus as set forth in claim 1 wherein said end portion of said drive shaft has a periphery extending around the axis of said drive shaft and has an end face extending transversely to said axis of said drive shaft and said handle assembly comprises a U-shaped handle with a portion thereof adjacent said end face of said drive shaft to prevent axial access to said end portion of said drive shaft, wherein said ratchet wheel is mounted on and secured to said drive shaft and wherein said pawl is mounted on said handle.

12. Hopper apparatus as set forth in claim 11 wherein said end portion of said drive shaft has a through opening extending transversely to said axis of said drive shaft and wherein said handle has a bridging plate extending over said opening in said drive shaft when said handle assembly is in said first position thereof for preventing access to said opening in said drive shaft in the direction of said bridging plate to the last-mentioned said opening.

* * * * *